United States Patent [19]

Bilsbury et al.

[11] Patent Number: 4,733,613

[45] Date of Patent: Mar. 29, 1988

[54] ADJUSTABLE VOLUME SHOT WAD STRUCTURE AND METHOD OF ASSEMBLING THE SAME

[75] Inventors: Stephen J. Bilsbury, Godfrey; Peter F. Grelle, Edwardsville, both of Ill.

[73] Assignee: Olin Corporation, Stamford, Conn.

[21] Appl. No.: 879,683

[22] Filed: Jun. 27, 1986

[51] Int. Cl.[4] ..... F42B 7/08

[52] U.S. Cl. ..... 102/532; 102/450; 102/461

[58] Field of Search ..... 102/448–463, 102/532

[56] References Cited

U.S. PATENT DOCUMENTS

| | | | |
|---|---|---|---|
| 3,053,185 | 9/1962 | Oberfell et al. | 102/450 X |
| 3,420,178 | 1/1969 | Rempel | 102/453 |
| 4,290,365 | 9/1981 | Dreyer | 102/464 X |
| 4,307,664 | 12/1981 | Vollers | 102/532 X |

*Primary Examiner*—Peter A. Nelson

*Attorney, Agent, or Firm*—Bruce E. Burdick

[57] ABSTRACT

An improved shot wad structure has a longer outer wad cup, a shorter inner wad cup and a plastic wad insert, and is useful in a shotshell with hard shot pellets, such as steel or tungsten shot. The outer cup, formed of a soft, low tensile strength material, such as polyethylene, is capable of obturating combustion gases produced in a gun barrel when the shotshell is fired, whereas the inner cup, formed of a tough, high tensile strength material, such as nylon, is adapted to support a shot column and is capable of withstanding compressive forces generated by shot acceleration to protect the barrel from being scored by the hard shot. The wad insert, disposed within the outer cup above its bottom and below the bottom of the inner cup, is formed of a foam material which is one-way crushable for permitting insertion of the inner cup within the outer cup to any one of several different depths therein at which a corresponding number of different volumes of space are defined within the outer cup for containing shot columns of various shot load sizes. The wad insert once crushed still has sufficient compressive strength to support the inner cup at the desired depth within the outer cup.

19 Claims, 7 Drawing Figures

ADJUSTABLE VOLUME SHOT WAD STRUCTURE AND METHOD OF ASSEMBLING THE SAME

CROSS REFERENCE TO RELATED APPLICATION

Reference is hereby made to the following copending U.S. patent application dealing with subject matter related to the present invention and assigned to the same assignee: "Improved Composite Shot Wad Structure for Steel and Other Hard Shot" by Stephen J. Bilsbury, assigned U.S. Ser. No. 801,678 and filed Nov. 25, 1985, and now abandoned.

BACKGROUND OF THE INVENTION

1. Field of the Invention

The present invention generally relates to shotshells and, more particularly, is concerned with an improved shot wad structure for shotshells which is assembled from components that are adjustable with respect to one another to accommodate a range of different sizes of shot loads or charges in shotshells.

2. Description of the Prior Art

It is conventional practice to provide plastic wad structures for use in shotshells to house the shot charge, obturate combustion gases, and cushion the shot charge when the loaded wad is fired from a shotgun. One wad structure representative of this practice is illustrated and described in U.S. Pat. No. 3,285,174 to V. C. Moehlman et al, which patent issued Nov. 15, 1966 and is assigned to the assignee of the present invention.

Typically, the wad structure has a unitary one-piece construction and is composed of a shot pocket portion, a filler or cushioning portion and an obturating portion. The shot pocket portion is shaped like a cup and includes a cylindrical split sidewall open at the top and closed at the bottom. The obturating portion has a shallow cup-like shape and includes a base with a peripheral flared skirt. The cushioning portion generally includes a series of flexible members which extend between and interconnect the other two portions of the wad structure.

When a shotshell containing the above-described wad structure is loaded in a shotgun and fired, a propellant disposed in the shell tube rearwardly of the obturating portion is consumed and produces high pressure combustion gases. The pressurized gases act upon the obturating portion, causing its skirt to expand outwardly into sealing relationship with the inner surface of the the shell tube and wall of the gun barrel bore. Such sealing increases the compressive forces being generated by the pressurized combustion gases. Since the column of shot pellets contained in the shot pocket portion of the wad structure initially resists forward movement, the compressive forces first compress the cushioning portion of the wad structure. Then, as the wad structure and shot column are propelled out of the shell tube and start to accelerate through the gun barrel, the shot column pushes radially outward toward the wall of the barrel bore and against the sidewall of the shot pocket portion.

Historically, shot pellets have been composed of lead which is much softer than the metal traditionally composing the gun barrel. Therefore, an important objective of the shot pocket portion of the wad structure heretofore has been to prevent contact of the softer shot pellets with the harder barrel in order to prevent leading of the barrel and distortion of the shot pellets. This objective of lead shot protection has been satisfactorily attained by the shot pocket portion design disclosed in the aforesaid patent.

However, due to the toxicity of lead and health concerns about possible retention of lead shot in game intended for human consumption, laws have recently been enacted in many states which substantially limit or even ban the use of traditional lead shot pellets in hunting game and mandate the use of hard materials having little or no known toxicity, such as steel or tungsten. While formerly in the case of lead shot pellets the objective of the shot pocket portion was to protect the softer shot pellets from the harder gun barrel, now in the case of steel shot pellets the new objective is to protect the softer gun barrel from the harder shot pellets. The shot pocket portions of wad structures designed for use with lead shot pellets have proven unable to meet this new objective. The plastic material used heretofore fails to withstand the compressive forces of the hard shot. The shot readily penetrates through the sidewall of the pocket portion and contacts the barrel wall, causing marring or scoring thereof. Merely making the plastic material heavier or thicker or substituting a stronger plastic material has not been found to provide a workable and economical solution to the problem of preventing barrel scoring. Plastic materials that are strong enough to withstand the force of the steel shot are usually expensive and, in some cases, too stiff to allow proper obturation of the propellant gases in cold weather.

This new objective which requires the use of a material exhibiting the dual properties of high tensile strength for barrel protection and high ductility for proper obturation is substantially satisfied by the unique laminated pocket portion of the improved composite shot wad structure of the above cross-referenced patent application. The laminated pocket portion has an inner liner of tough, high tensile strength material, such as nylon, and an outer body of soft, low tensile strength material, such as polyethylene, which also composes the remainder of the wad structure. On the one hand, the tough, high tensile strength inner liner adapts the pocket portion to withstand the radially-directed compressive forces generated by acceleration of hard shot, such as steel or tungsten shot, in the barrel of a shotgun. The hard shot is prevented from penetrating the pocket portion sidewall and coming in contact with and marring the shotgun barrel. On the other hand, the soft, low tensile strength outer body adapts the wad structure to obturate effectively.

While the composite shot wad structure with the unique laminated pocket portion of the above cross-referenced application protects the shotgun barrel without sacrificing obturation capacity, it lacks flexibility in loading in that it will only accommodate one load size. This shortcoming makes it necessary to manufacture several sizes of wad structures with different volumes of loading capacity which increases manufacturing costs.

One attempt to accommodate a range of load sizes in one shot wad structure is illustrated and described in U.S. Pat. No. 3,788,224 to Merritt. Basically, a longer shot protector cup telescopes at its lower end into an upper mouth of a shorter sealing overpowder cup to provide a variable volume within the shotshell. The two cups tend to trap air between them, or, alternatively, the shorter cup incorporates a center post, which resists telescoping of the longer cup into the shorter one. Thus, stresses are built into the shot wad structure which increase in proportion to the increase in the volume of the shot loading capacity of the longer cup as the latter is forced further down into the shorter cup. While this relationship may have some benefits in terms of reducing shot deformation when soft lead shot is used, hard steel shot does not deform and so building in stresses would merely increase the complexity of the steps required in assembling the lower end of the longer cup into the mouth of the shorter cup. Furthermore, since both of the partially telescoped cups are made from the same relatively soft plastic material, the shot wad structure of this patent is not adapted to prevent penetration of the hard steel shot through the sidewall of the longer cup and thus would fail to protect the shotgun barrel.

Consequently, a need exists to come up with a solution which will overcome the problems of sidewall penetration and shotgun barrel marring by hard shot and of inadequate flexibility in shot loading capacity, while at the same time be one which is workable and economical in the sense that it takes advantage of conventional high-speed automatic assembling techniques.

SUMMARY OF THE INVENTION

The present invention provides an improved shot wad structure designed to satisfy the aforementioned needs. The improved wad structure of the invention is assembled from three separate components—a shorter inner wad cup, a longer outer wad cup and a one-way crushable wad insert—that are adjustable with respect to one another to accommodate a range of different sizes of shot loads without building stresses into the wad structure. Additionally, the inner cup is composed of a material which accommodates the use of hard shot. The wad insert is disposed within the outer cup between its bottom and that of the inner cup. The inner cup is movable relative to the outer cup to establish the shot load size desired within the wad structure.

As the inner cup is moved further into the outer cup to adjustably increase the shot load volume in the outer cup and thereby the shot loading size or capacity in the wad structure, the wad insert is increasingly crushed proportionally; however, there is no increase in stresses within the wad structure. The material which composes the wad insert is preferably a syntactic foam which exhibits a non-resilient, one-way crushable behavior, allowing the inner cup to be inserted to the depth or elevation within the outer cup necessary to provide the shot load size desired, but has sufficient strength to support the load at the elevation to which it is inserted and resist further crushing during normal handling of the shotshell.

Accordingly, the present invention is directed to an improved shot wad structure for use in a shotshell with hard shot pellets having a hardness generally at least equal to that of the barrel of a gun in which the shotshell is to be fired. The improved shot wad structure includes: (a) an outer wad cup having a bottom portion capable of obturating combustion gases produced when a shotshell containing the wad structure is fired and a sidewall portion which together with the bottom portion defines a pocket open at one end; (b) an inner wad cup having a bottom and sidewall which define a cavity open at one end for receiving and supporting a column of shot, the inner cup being movably insertable into the pocket of the outer cup to any one of a number of different depths therein at which any one of a corresponding number of different volumes of space is defined within the outer cup for containing a column of shot having any one of a number of different shot load sizes, the inner cup being capable of withstanding compressive forces generated by acceleration of the column of shot when a shotshell containing the wad structure is fired; and (c) a plastic wad insert disposed within the pocket of the outer cup between the bottom portion thereof and the bottom of the inner cup when inserted therein, the wad insert being formed of a foam material which is non-resilient and one-way crushable for permitting insertion of the inner cup into the pocket of the outer cup to any one of the number of different depths therein, the crushed material having sufficient compressive strength to support the inner cup at any one of the different depths within the pocket of the outer cup. Also, the outer cup is substantially longer than the inner cup.

More particularly, the outer wad cup is formed of a low tensile strength, soft plastic material, such as polyethylene, whereas the inner wad cup is preferably formed of a high tensile strength, tough plastic material, such as nylon. Alternatively, the inner cup can be formed of a metallic material, such as aluminum. Finally, the plastic wad insert can be a plastic foam, or, more particularly, a syntactic foam.

Furthermore, the present invention is also directed to a method of assembling a shot wad structure for establishing a desired volume of space in which to contain a column of shot of a desired size in the wad structure. The assembling method includes the steps of: (a) providing a longer outer cup having a bottom portion capable of obturating combustion gases produced when a shotshell containing the wad structure is fired and a sidewall which together with the bottom portion defines a pocket open at one end; (b) providing a shorter inner cup having a bottom and sidewall which define a cavity open at one end for receiving and supporting a column of shot, the inner cup being movably inserted into the pocket of the outer cup and being capable of withstanding compressive forces generated by acceleration of the column of shot when a shotshell containing the wad structure is fired; (c) providing a plastic wad insert disposed within the pocket of the outer cup above the bottom portion thereof and below the inner cup inserted within the pocket of the outer cup, the wad insert being formed of a foam material which is non-resilient and one-way crushable for permitting further insertion of the inner cup into the pocket of the outer cup to any one of a number of different depths therein, the foam material once crushed having sufficient compressive strength to support the inner cup at any one of the different depths within the pocket of the outer cup; and (d) crushing the wad insert to an extent which allows insertion of the inner cup to a desired one of the number of different depths therein at which a desired one of a corresponding number of different volumes of space is defined within the outer cup for containing a column of shot having a desired one of a number of different shot load sizes.

The crushing of the wad insert to allow insertion of the inner cup to the desired one depth is accomplished concurrently with forming of a plurality of circumferentially spaced longitudinal slits through the respective sidewalls of the outer and inner cups which facilitate separation of the outer and inner cups from the column of shot after a shotshell containing the shot wad structure emerges from the barrel of a gun from which the shotshell is fired. More particularly, the crushing of the wad insert to allow insertion of the inner cup to the desired one depth is accomplished by inserting a member mounting external knives into the inner cup and moving the member through a predetermined length of stroke which concurrently forces the inner cup against the wad insert to the desired one depth into the outer cup and forms a plurality of circumferentially spaced longitudinal slits through the respective sidewalls of the outer and inner cups which facilitate separation of the outer and inner cups from the column of shot after a shotshell containing the shot wad structure emerges from the barrel of a gun from which the shotshell is fired.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
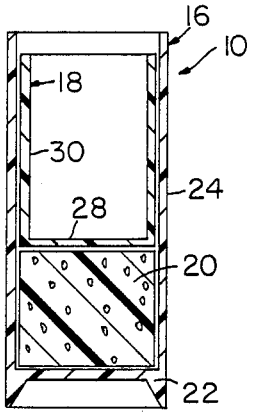
FIG. 1 is an enlarged elevational view, in section, of an improved wad structure constructed in accordance with the principles of the present invention.
Figure 2:
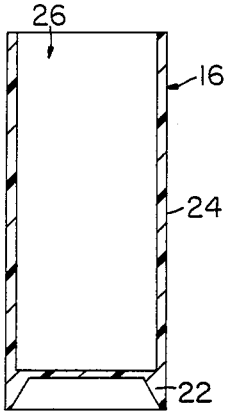
FIG. 2 is an elevational view, in section, of a longer outer wad cup of the improved wad structure of FIG. 1.
Figure 3:
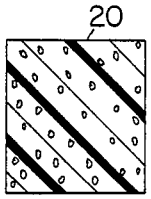
FIG. 3 is an elevational view, in section, of a one-way crushable wad insert of the improved wad structure of FIG. 1.
Figure 4:
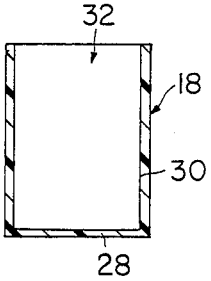
FIG. 4 is an elevational view, in section, of a shorter inner wad cup of the improved wad structure of FIG. 1.

Referring now to the drawings, and particularly to FIGS. 1 to 4, there is shown in assembled and disassembled forms, an improved shot wad structure, generally designated by the numeral 10 in FIG. 1 and constructed in accordance with the present invention. While useful with softer shot, such as shot made of lead, the improved wad structure 10 is particularly useful in a shotshell 12 with hard shot pellets 14, such as ones made of steel, tungsten or other hard material, having a hardness generally at least equal to that of the barrel of the gun in which the shotshell is to be fired.

Basically, the improved shot wad structure 10 includes three components—a longer outer wad cup 16, a shorter inner wad cup 18 and a plastic wad insert 20. The outer wad cup 16 has a bottom portion 22 integrally-connected to an endless cylindrical sidewall 24 and defining a cylindrical pocket 26 therewith open at its upper end. Similarly, the inner cup 18 has an integrally-connected bottom 28 and endless cylindrical sidewall 30 which define a cylindrical cavity 32 open at its upper end. Thus, the outer and inner cups 16, 18 both have cup-like cross-sectional shapes. The inner cup 18 has an outside diameter slightly less than the inside diameter of the pocket 26 of the outer cup 16, allowing the inner cup 18 to be slidably inserted therein in a close fitting relationship. Furthermore, the sidewall 30 of the inner cup 18 is substantially shorter in length than the sidewall 24 of the outer cup 16 such that the inner cup 18 is entirely contained within the pocket 26 of the outer cup 16 and encompassed by its sidewall 24 when inserted therein.

The outer cup 16 is formed of a soft, low tensile strength material adapting its bottom portion 22 for obturating combustion gases produced in the gun barrel when the shotshell 12 containing the improved wad structure 10 is fired. The inner cup 18 is formed of a tough, high tensile strength material, adapting it to receive and support a column of the hard shot 14 in its cavity 32. The material of the inner cup 18 withstands the compressive forces generated by acceleration of the column of shot 14 when the shotshell 12 is fired thereby protecting the gun barrel from being scored by the shot.

The plastic wad insert 20 is formed in the shape of right cylinder and has an outside diameter slightly less than the inside diameter of the pocket 26 of the outer cup 16, permitting the insert 20 to be disposed within the pocket of the outer cup above its bottom portion 22 and below the bottom 28 of the inner cup 18. Preferably, the wad insert 20 is formed of a foam material which is non-resilient and one-way crushable for permitting insertion of the inner cup 18 within the outer cup 16 to a desired depth which via the cavity 32 in the inner cup defines a corresponding volume of space within the outer cup 16 for containing a column of shot 14 having a particular shot load size. Once crushed to a degree which accommodates insertion of the inner cup 18 to its desired depth, the wad insert 20 still retains sufficient compressive strength to support the inner cup 18 at the desired depth within the outer cup 16.

Therefore, the wad insert 20 facilitates insertion of the inner cup 18 supporting the column of shot 14 to any one of a number of different depths or elevations within the outer cup 16. Thus, through correct positioning of the inner cup 18 within the outer cup 16 and crushing of the wad insert 20, any one of a corresponding number of different volumes of space can be defined within the outer cup 16 between the bottom 28 of the inner cup 18 and the open upper end of the outer cup for containing a shot column having any one of a number of different shot load sizes. Examples of such different sizes are 1, $1\frac{1}{8}$, $1\frac{1}{4}$ and $1\frac{1}{2}$ ounce sizes. The generally uniform compressive strength of the wad insert 20 permits support and retention of the inner cup 18 at any one of the different depths within the pocket 26 of the outer cup 18.

In an exemplary embodiment, the outer wad cup 16 can be formed by injection molding from a plastic material having a minimum tensile strength of approximately 2500 psi at 70 degrees F. (ASTM - D-638) and a maximum hardness of approximately Shore D-70 at 70 degrees F. (ASTM - D-2240). An example of such material is high density polyethylene. The inner wad cup 18 can be formed by injection molding from a plastic material having a minimum tensile strength of approximately 6000 psi at 70 degrees F. (ASTM D-638), a minimum IZOD impact strength of approximately 5.0 ft-lbs/inch at 0 degrees F. (ASTM - D-256), and a minimum hardness of approximately R-80 at 70 degrees F. (ASTM - D-785). An example of such material is an engineering plastic resin such as filled or unfilled nylon, polyester, or polycarbonate. Alternatively, the inner cup 18 can be formed by drawing from a metallic material having a minimum ultimate tensile strength of approximately 13,000 psi at 70 degrees F. (ASTM - B-209), a maximum density of approximately 8.5 grams/cm$^3$, and a hardness of approximately Brinell 23 (ASTM - B-209). Examples are aluminum and steel. The wad insert 20 can be a plastic foam having a minimum compressive strength of approximately 5 psi, but prefereably is a syntactic foam having a minimum compressive strength of approximately 100 psi. An example is expandable polystyure.

For purposes of definition, a "plastic foam" is the name most commonly used to describe the two-phase system of a gas dispersed in a solid plastic. In most cases, the plastic represents only a minor portion of the volume of the composite system, but contributes largely to its properties and utility. Other terms used interchangeably for plastic foams are cellular plastics, foamed plastics, expanded plastics, and plastic sponges. The term "syntactic foam" refers to the material formed by distributing individual foam particles, such as epoxy, phenolic, urea-formaldehyde and polystyrene foams, in a solid plastic. (These definitions are taken from Chapter 15 of "Engineering Design For Plastics" by Eric Baer, Reinhold Publishing Company, 1964.)

Figure 5:
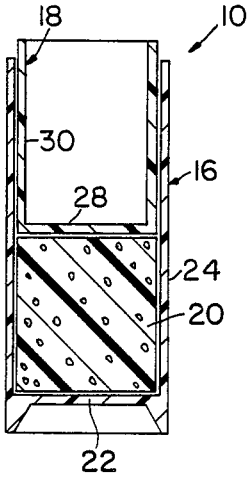
FIG. 5 is an elevational view, in section, of the improved wad structure of FIG. 1 before the inner cup is inserted to the desired depth within the outer cup and the wad insert is crushed so as to provide the desired volume within the outer cup to thereby establish the desired shot loading size of the shot wad structure.
Figure 6:
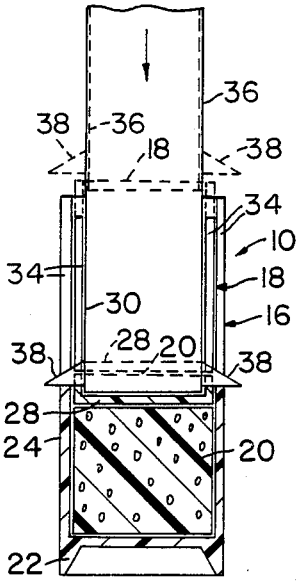
FIG. 6 is an elevational view, in section, of the improved wad structure of FIG. 1, depicting a slitting tool of a high-speed automatic assembly machine which slits concurrently the sidewalls of the inner and outer wad cups and causes forcible insertion of the inner cup to the desired depth in the outer cup and crushing of the wad insert to the desired degree.

For assembling the improved shot wad structure 10, only conventionally available high-speed automatic assembly machines need be used. In order to assemble the wad structure 10 from its condition shown in FIG. 5 to that seen in FIG. 6 so as to establish the desired volume of space in the outer cup 16 in which to contain a column of shot 14 having a desired size in the wad structure 10, the wad insert 20 must be crushed to the degree or extent necessary to allow insertion of the inner cup 18 to a desired depth within the pocket 26 of the outer cup 16 which corresponds to or provides that desired volume of space therein. Such crushing of the wad insert 20 is most efficiently carried out concurrently with the forming of a plurality of circumferentially spaced longitudinal slits 34 through the respective sidewalls 24, 30 of the outer and inner cups 16, 18. These slits 34 facilitate separation of the cups from the column of shot 14 after the shotshell containing the shot wad structure 10 emerges from the barrel of a gun from which the shotshell is fired. In particular, as seen in FIG. 6, a plunger 36 mounting external knives 38 is inserted into the cavity 32 of the inner cup 18 and moved through a predetermined length of stroke which concurrently forces the inner cup 18 against the wad insert 20 to the desired depth into the outer cup 16 and forms the circumferentially spaced longitudinal slits 34 through the respective sidewalls 24, 30 of the outer and inner cups.

Figure 7:
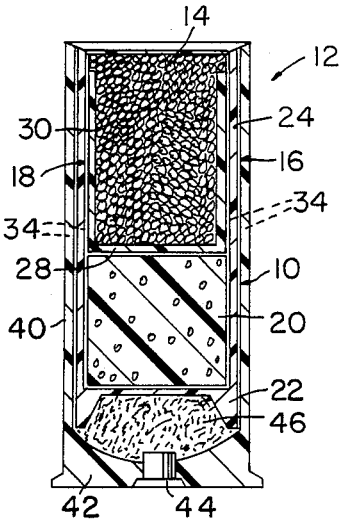
FIG. 7 is an elevational view, in section, of a shotshell containing the improved wad structure of FIG. 1.

In FIG. 7, the improved wad structure 10 now in assembled form is shown installed in a conventional manner as part of the loaded shotshell 12. The cylindrical casing 40 of the shell 12 encompasses the wad structure. The shell 12 includes a base 42 at one end of the casing 40 and an infolded end closure at the other end. A primer 44 is positioned in the base 42 and is operative upon being struck by a firing pin to ignite a propellant charge 46 inside the casing 40. The improved wad structure 10 is positioned in the casing 40 with the bottom or obturating portion 22 of the outer cup 16 adjacent to the propellant charge 46. The column of shot 14 of the desired size is positioned inside the space in the pocket 26 of the outer cup 16 which is occupied by the cavity 32 of the inner cup 18 and is spaced above the obturating portion 22 of the outer cup 16 by the wad insert 20.

Upon firing the propellant charge 46, explosive gases act upon the bottom or obturating portion 22 of the outer cup 16 causing it to flare outwardly against the casing 40 forming an effective gas seal. The propellant forces are transmitted from the obturating portion 22 of the outer cup 16 through the wad insert 20 to the column of shot 14 in the inner cup 18, which, it will be recalled, is not attached to the outer cup. As the wad structure 10 and shot column leave the shell 12 and travel down the barrel of the gun, the shot 14 bulges outwardly against the barrel, but the barrel is shielded or protected from marring or scoring from contact with the hard shot 14 by the inner cup 18. Also, the presence of the soft material of the outer cup 16 outside of the bulging inner cup 18 increases the effectiveness of the sealing between the shot wad structure 10 and the barrel. Since most of the compressive forces of the shot column are felt at the bottom 28 of the inner cup 16 and not at the top thereof, then even if, due to the size of the shot column, shot pellets are present directly against the sidewall 24 of the outer cup 16 above the top of the inner cup 18 no penetration of the soft sidewall 24 is to be expected.

It is though that the improved shot wad structure of the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

We claim:

1. An improved shot wad structure, comprising:

(a) an outer wad cup having a bottom portion capable of obturating combustion gases produced when a shotshell containing said wad structure is fired and a sidewall portion which together with said bottom portion defines a pocket open at one end;

(b) an inner wad cup having a bottom and sidewall which define a cavity open at one end for receiving and supporting a column of shot, said inner cup being movably insertable into said pocket of said outer cup to any one of a number of different depths therein at which any one of a corresponding number of different volumes of space is defined within said outer cup for containing a column of shot having any one of a number of different shot load sizes, said inner cup being capable of withstanding compressive forces generated by acceleration of the column of shot when a shotshell containing said wad structure is fired; and (c) a plastic wad insert disposed within said pocket of said outer cup between said bottom portion thereof and said bottom of said inner cup when inserted therein, said wad insert being formed of a foam material which is non-resilient and one-way crushable for permitting insertion of said inner cup into said pocket of said outer cup to said any one of said number of different depths therein, said crushed material having sufficient compressive strength to support said inner cup at said any one of said different depths within said pocket of said outer cup.

2. The wad structure as recited in claim 1, wherein said sidewall portion of said outer cup is greater in length than said sidewall of said inner cup.

3. The wad structure as recited in claim 1, wherein said outer cup is formed of polyethylene.

4. The wad structure as recited in claim 1, wherein said outer cup is formed of a low tensile strength, soft plastic material having a minimum tensile strength of approximately 2500 psi at 70 degrees F. and a maximum hardness of approximately Shore D-70 at 70 degrees F.

5. The wad structure as recited in claim 1, wherein said inner cup is formed of nylon.

6. The wad structure as recited in claim 1, wherein said inner cup is formed of a high tensile strength, tough plastic material having a minimum tensile strength of approximately 6000 psi at 70 degrees F., a minimum IZOD impact strength of approximately 5.0 ft-lbs/inch at 0 degrees F., and a minimum hardness of approximately R-80 at 70 degrees F.

7. The wad structure as recited in claim 1, wherein said inner cup is formed of a high tensile strength, tough metallic material having a minimum ultimate tensile strength of approximately 13,000 psi at 70 degrees F., a maximum density of approximately 8.5 grams/cm$^3$, and a hardness of approximately Brinell 23.

8. The wad structure as recited in claim 1, wherein said plastic wad insert is a syntactic foam having a minimum compressive strength of approximately 100 psi.

9. The wad structure as recited in claim 1, wherein said plastic wad insert is a plastic foam having a minimum compressive strength of approximately 5 psi.

10. An improved shot wad structure for use in a shotshell with shot pellets having a hardness generally at least equal to that of the barrel of a gun in which the shotshell is to be fired, said wad structure comprising:

(a) an outer body being formed of a soft, low tensile strength material and having a cup-like cross-sectional shape and a bottom portion capable of obturating the combustion gases produced in the gun barrel when the shotshell is fired;

(b) an inner body having a cup-like cross-sectional shape for receiving and supporting a column of shot and being movably insertable within said outer body to any one of a number of different depths therein at which any one of a corresponding number of different volumes of space is defined within said outer body for containing a column of shot having any one of a number of different shot load sizes, said inner body being formed of a tough, high tensile strength material capable of withstanding compressive forces generated by acceleration of the shot, when the shotshell containing said wad structure is fired in the barrel of the gun, so as to protect the gun barrel from being scored by the shot; and (c) a wad insert disposed within said outer body between said bottom portion thereof and said inner body inserted therein, said wad insert being formed of a material which is one-way crushable for permitting insertion of said inner body within said outer body to said any one of said number of different depths therein, said crushed material having sufficient compressive strength to support said inner body at said any one of said different depths within said pocket of said outer body.

11. The wad structure as recited in claim 10, wherein said outer body has a sidewall which is greater in length than a sidewall of said inner body.

12. The wad structure as recited in claim 10, wherein said outer body is a formed of a plastic material having a minimum tensile strength of approximately 2500 psi at 70 degrees F. and a maximum hardness of approximately Shore D-70 at 70 degrees F.

13. The wad structure as recited in claim 10, wherein said inner body is formed of a plastic material having a minimum tensile strength of approximately 6000 psi at 70 degrees F., a minimum IZOD impact strength of approximately 5.0 ft-lbs/inch at 0 degrees F., and a minimum hardness of approximately R-80 at 70 degrees F.

14. The wad structure as recited in claim 10, wherein said inner body is formed of a metallic material having a minimum ultimate tensile strength of approximately 13,000 psi at 70 degrees F., a maximum density of approximately 8.5 grams/cm$^3$, and a hardness of approximately Brinell 23.

15. The wad structure as recited in claim 10, wherein said plastic wad insert is a syntactic foam having a minimum compressive strength of approximately 100 psi.

16. The wad structure as recited in claim 10, wherein said plastic wad insert is a plastic foam having a minimum compressive strength of approximately 5 psi.

17. Method of assembling a shot wad structure for establishing a preselected volume of space in which to contain a column of shot of a desired size in said wad structure, comprising the steps of:

(a) providing an outer wad cup having a bottom portion capable of obturating combustion gases produced when a shotshell containing said wad structure is fired and a sidewall which together with said bottom portion defines a pocket open at one end;

(b) providing an inner wad cup having a bottom and sidewall which define a cavity open at one end for receiving and supporting a column of shot, said sidewall of said inner cup being shorter than said sidewall of said outer cup, said inner cup being movably inserted into said pocket of said outer cup and capable of withstanding compressive forces generated by acceleration of the column of shot when a shotshell containing said wad structure is fired;

(c) providing a plastic wad insert disposed within said pocket of said outer cup above said bottom portion thereof and below said inner cup inserted within said pocket of said outer cup, said wad insert being formed of a foam material which is non-resilient and one-way crushable for permitting further insertion of said inner cup into said pocket of said outer cup to any one of a number of different depths therein, said foam material once crushed having sufficient compressive strength to support said inner cup at said any one of said different depths within said pocket of said outer cup; and (d) crushing of said wad insert to an extent which allows insertion of said inner cup to a desired one of said number of different depths therein at which a desired one of a corresponding number of different volumes of space is defined within said outer cup for containing a column of shot having a desired one of a number of different shot load sizes.

18. The assembling method as recited in claim 17, wherein said crushing of said wad insert to allow insertion of said inner cup to said desired one depth is accomplished concurrently with forming of a plurality of circumferentially spaced longitudinal slits through said respective sidewalls of said outer and inner cups which facilitate separation of said cups from said column of shot after a shotshell containing said shot wad structure emerges from the barrel of a gun from which the shotshell is fired.

19. The assembling method as recited in claim 17, wherein said crushing of said wad insert to allow insertion of said inner cup to said desired one depth is accomplished by inserting a member mounting external knives into said inner cup and moving said member through a predetermined length of stroke which concurrently forces said inner cup against said wad insert to said desired one depth into said outer cup and forms a plurality of circumferentially spaced longitudinal slits through said respective sidewalls of said outer and inner cups which facilitate separation of said cups from said column of shot after a shotshell containing said shot wad structure emerges from the barrel of a gun from which the shotshell is fired.

* * * * *